United States Patent [19]

Lowdon

[11] Patent Number: 4,643,843

[45] Date of Patent: Feb. 17, 1987

[54] PREPARATION FOR IMPROVING THE RELIABILITY OF ELECTRICAL CONNECTIONS

[76] Inventor: Harold L. Lowdon, 9337 Crestedge, Dallas, Tex. 75238

[21] Appl. No.: 848,928

[22] Filed: Apr. 7, 1986

Related U.S. Application Data

[63] Continuation-in-part of Ser. No. 740,760, Jun. 3, 1985, abandoned.

[51] Int. Cl.[4] ..... H01B 1/06

[52] U.S. Cl. ..... 252/510; 252/503; 252/506; 252/508; 252/512; 252/518; 252/514; 429/121; 339/278 C

[58] Field of Search ..... 252/500, 502, 503, 506, 252/508, 509, 510, 512, 518, 514; 106/287.34; 429/248-252, 7, 65, 121; 339/278 C, DIG. 3

[56] References Cited

U.S. PATENT DOCUMENTS

Re. 31,454 12/1983 Hymes ..... 128/641

OTHER PUBLICATIONS

Encyclopedia of Chemical Technology, vol. 12, 3rd Edition, p. 56, "Gum Karaya".

*Primary Examiner*—Josephine L. Barr

*Attorney, Agent, or Firm*—James H. Phillips

[57] ABSTRACT

In order to maintain the long term reliability of an electrical connection subjected to difficult environmental conditions, such as in the engine compartment of a motor vehicle, a paste-like preparation is provided for application at the conductively mating surfaces of the connection. A first embodiment of the preparation includes water, glycerin, a thixotropic agent and a hydrophilic substance, such as calcium chloride or lithium chloride, exhibiting sufficient hydrophilic action and in sufficient quantity as to maintain the preparation in a fluid state by absorbing moisture from the ambient atmosphere. Variants of the preparation include, as one or more additional ingredients, acetic acid and/or powdered graphite or metallic powder or flakes of high conductivity such as copper, aluminum or silver. A second and presently preferred embodiment of the preparation includes detergent, ethylene glycol, fine sand and powdered graphite in conjunction with a high concentration of calcium chloride or lithium chloride.

2 Claims, No Drawings

PREPARATION FOR IMPROVING THE RELIABILITY OF ELECTRICAL CONNECTIONS

CROSS REFERENCE TO RELATED APPLICATION

This application is a continuation-in-part of Ser. No. 740,760, filed June 3, 1985, now abandoned, by Harold L. Lowdon and also entitled "Preparation for Improving the Reliability of Electrical Connections".

FIELD OF THE INVENTION

This invention relates to the electrical connection art and more particularly, to a preparation which, upon application to an electrical connection, serves to maintain the reliability of the connection over a long period.

BACKGROUND OF THE INVENTION

Electrical connections, particularly those which intermittently carry relatively high currents, are susceptible to failure as a result of corrosion in which a layer of non-conductive material (for example, an oxide layer) develops at the point of connection to render an apparently secure connection electrically marginal or unusable. A highly prevalent and notorious example is the pair of detachable connections to the battery in automotive vehicles and the like. Such connections typically take the form of a screw (or otherwise) tightenable assembly at the end of a battery cable which is introduced over a lead battery terminal and simply tightened to afford frictional engagement. The presence of corrosive fumes, high operating temperatures, intermittent high current demand (as when starting), and other harsh operating conditions result in a condition of apparent battery failure which can only be genuinely remedied by removing the cable, cleaning both the connector assembly and the battery terminal and reconnecting the cable.

Various attempts in the past have been made to counteract this ubiquitous problem. One common procedure is to coat the assembled connection with a layer of grease, the object being to "seal" the connection to thereby prevent the corrosive fumes from accessing the interface between the connector assembly and the battery terminal to thereby inhibit the chemical reaction which produces the layer of non-conductive material. Although this procedure is helpful, at least temporarily, in slowing down the formation of the non-conductive layer, the "seal" is either never fully effected (the bottom of the connector often being inaccessible to applying the grease layer) or it fails as the grease is subjected to the aforementioned underhood conditions. Another approach, sometimes employed particularly with automotive battery connections, is to place a material proximate the battery connection (for example, a ring of the material introduced over the battery terminal before the connector assembly) which serves to chemically inhibit the effect of the corrosive fumes at the interface between the battery terminal and the connector assembly. Experience has shown that this approach is of limited effectiveness over a lifetime which is also limited.

Therefore, those skilled in the electrical art will appreciate that it would be highly desirable to provide means by which electrical connections of long term reliability may be obtained, especially those connections made in harsh environments such as experienced at the battery terminals under the hood in an automotive vehicle.

OBJECTS OF THE INVENTION

It is therefore a broad object of my invention to provide a means by which an electrical connection of long term reliability may be achieved.

It is a further object of my invention to provide such means which is particularly effective in electrical connections made to a battery operating under harsh conditions such as those experienced in an engine compartment.

In another aspect, it is an object of my invention to provide a preparation which, when applied at the interface of an electrical connection, as between a battery terminal and a cable connector assembly, serves to insure the long term integrity of the electrical connection.

In a more specific aspect, it is an object of my invention to provide such a preparation which is itself conductive and which maintains its conductivity and fluidity by drawing moisture from the ambient atmosphere.

SUMMARY OF THE INVENTION

These and other objects of my invention are achieved by providing a preparation comprising water, glycerin and a thixotropic agent in a mixture further including a hydrophilic substance exhibiting sufficient hydrophilic action and in sufficient quantity as to maintain the preparation in a fluid state by absorbing moisture from the ambient atmosphere. Variants of the preparation include, as a further ingredient, which serves to further decrease the resistance of the preparation, powdered graphite, metallic powder or metallic flakes. Further variants of the preparation employ, with the high concentration of a hydrophilic substance, detergent, ethylene glycol, fine sand and powdered graphite. In these variants, lithium chloride is the preferred hydrophilic substance.

DETAILED DESCRIPTION OF THE INVENTION

In order to meet the foregoing stringent objects of the invention, applicant's preparation must remain fluid and conductive indefinitely and must have the ability to unilaterally recover from periods of use under extraordinarily difficult conditions. In accordance with a first embodiment of the invention, these results are obtained by the use of a preparation obtained by combining four parts water, six parts glycerin, one part calcium chloride or lithium chloride, and twelve parts of a thixotropic agent such as synthetic amorphous fumed silica which, by way of example only, is commercially available from Cabot Corporation under the trademark Cabosil. The resulting preparation is of pastelike consistency and may readily be applied to the conductively mating surfaces of an electrical connection. For example, when used in a contemplated typical application, the underhood battery terminals of a vehicle, the battery cable connectors are removed from the battery terminals, the terminals and mating surfaces of the connectors cleaned, the paste smeared on the conductively mating surfaces, and the connectors reassembled to the battery terminals. The excess paste may then be wiped away since this material need not cover the entire connector assembly as is sometimes attempted with grease.

The relatively high concentration of calcium chloride (or lithium chloride) contributes significantly to the strongly hydrophilic properties of the resulting paste.

As a result, even under conditions of extended periods of use in very high underhood temperatures, any water loss is recovered from the ambient atmosphere.

It has been found that the conductivity of the paste may be somewhat increased by substituting common vinegar for water. The vinegar, itself, is, of course, mostly water and further includes acetic acid to which the improvement in conductivity is attributable. Typically, therefore, the acetic acid, if used, is in a concentration of about the range 3–6% of the water constituent of the preparation.

The conductive properties of the film disposed between contactingly mating surfaces can be still further increased by adding, to the mixture set forth above (with or without acetic acid), ten parts of powdered graphite, conductive metallic powder or conductive metallic flakes. For most applications, aluminum or copper are the choices for the conductive metallic powder or flakes, however, powdered graphite is employed to advantage in one presently preferred embodiment of the invention. Those skilled in the electrical arts will appreciate that, for demanding applications in which cost is not a significant factor, silver in powdered or flaked form will achieve the highest conductivity (lowest resistance) junction of the several metallic conductor choices. In general applications, such as with vehicle batteries, powdered or flaked aluminum and copper, and particularly powdered graphite, all provide excellent results. Copper has a slight advantage over aluminum in that it has a higher conductivity; also, the aluminum has a slight tendency to react in the mixture to generate small hydrogen bubbles which, however, are of no consequence to the use of the paste.

If powdered graphite or metallic conductive powder is employed in the mixture, it may simply be stirred into the mixture with the rest of the ingredients to provide a generally homogeneous paste. However, because of surface tension effects on the relatively "broad" surface areas of conductive metallic flakes, it has been found useful to first wet the flakes with a miscible wetting agent which greatly facilitates mixing the flakes into the paste with the remaining ingredients. Any wetting agent miscible with water can be used, and one inexpensive example is isopropyl alcohol.

A presently preferred embodiment of the invention employs a very stable solution of lithium chloride and water of such proportions as to vary only insignificantly with changes in atmospheric humidity and temperature. The presently preferred mixture consists of:

| | |
|---|---|
| Water | 10–18 parts/wt |
| Detergent | 32–52 parts/wt |
| Ethylene glycol | 10–18 parts/wt |
| Fine sand (80–128 mesh) | 1–4 parts/wt |
| Powdered Graphite | 50–70 parts/wt |
| Lithium chloride brine (4 to 1 solution) | 10–18 parts/wt |

The detergent may be alkylphenolethoxylate which is commercially available as "Surfonic N95" from Texaco, Inc. Much of the water ingredient may be provided in a commercially available water based liquid detergent such as "409" from the Clorox Company. The alkylphenolethyoxylate detergent provides a non-volatile agent for wetting the graphite particles as well as the metal surfaces the paste is applied to. The ethylene glycol lowers the viscocity of the solution in order that more graphite powder may be incorporated into the mixture for increased conductivity. The liquid detergent, if used, further decreases the viscocity of the liquid medium which also permits the use of more graphite.

The key lithium chloride brine ingredient increases the conductivity of the paste and, through its strong hydrophilic properties, is able to retain water (and conductivity) at underhood temperatures even under ambient conditions of high temperature and low humidity and even to the extent of absorbing water from the air to maintain its fluid and electrically conductive characteristic of the paste indefinitely. Lithium chloride is preferred over calcium chloride in this application because it has a more pronounced hydrophilic characteristic and may be less corrosive. The fine sand is useful to provide enough abrasiveness to prevent the battery clamp from sliding up and off a tapered battery terminal as the clamp bolt is tightened which is otherwise a possible consequence of the lubricating qualities of the graphite ingredient.

While the principles of the invention have now been made clear in illustrative embodiments, there will be immediately obvious to those skilled in the art many modifications of proportions, the elements, materials, and components used in the practice of the invention which are particularly adapted for specific environments and operating requirements without departing from those principles.

I claim:

1. A preparation for providing long term integrity for electrical connections to which the said preparation has been applied, said preparation comprising a mixture in which the proportions by weight of the ingredients include:

| | |
|---|---|
| (A) water | 4 parts |
| (B) glycerin | 6 parts |
| (C) synthetic amorphous fused silica | 12 parts |
| (D) conductive particles selected from the group consisting of metallic flakes, metallic powder and powdered graphite | 10 parts |
| (E) a hydrophilic substance selected from the group consisting of calcium chloride and lithium chloride | 1 part. |

2. A preparation for providing long term integrity for electrical connections to which said preparation has been applied, said preparation comprising a mixture in which the proportions by weight of the ingredients fall within the following ranges:

| | |
|---|---|
| (A) water | 10–18 parts |
| (B) detergent | 32–52 parts |
| (C) ethylene glycol | 10–18 parts |
| (D) fine sand (80–128 mesh) | 1–4 parts |
| (E) powdered graphite | 50–70 parts |
| (F) lithium chloride brine (4 to 1 solution) | 10–18 parts. |

* * * * *